US011153695B2

(12) United States Patent
Ma

(10) Patent No.: US 11,153,695 B2
(45) Date of Patent: Oct. 19, 2021

(54) HEARING DEVICES AND RELATED METHODS

(71) Applicant: GN HEARING A/S, Ballerup (DK)

(72) Inventor: Changxue Ma, Barrington, IL (US)

(73) Assignee: GN Hearing A/S, Ballerup (DK)

( * ) Notice: Subject to any disclaimer, the term of this patent is extended or adjusted under 35 U.S.C. 154(b) by 0 days.

(21) Appl. No.: 16/827,694

(22) Filed: Mar. 23, 2020

(65) Prior Publication Data

US 2021/0297792 A1 Sep. 23, 2021

(51) Int. Cl.
*H04R 25/00* (2006.01)

(52) U.S. Cl.
CPC ..... *H04R 25/505* (2013.01); *H04R 25/70* (2013.01); *H04R 2225/43* (2013.01)

(58) Field of Classification Search
CPC ... H04R 25/505; H04R 25/70; H04R 2225/43
See application file for complete search history.

(56) References Cited

U.S. PATENT DOCUMENTS

2008/0175399 A1* 7/2008 Kim ..... H04R 3/005 381/57
2010/0098262 A1* 4/2010 Frohlich ..... H04R 25/70 381/60
2011/0224976 A1* 9/2011 Taal ..... G10L 25/69 704/205
2013/0142345 A1* 6/2013 Waldmann ..... H04R 25/70 381/56
2014/0314260 A1 10/2014 Aubreville et al.
2017/0256269 A1* 9/2017 Jensen ..... H04R 25/552
2017/0353805 A1* 12/2017 Mustiere ..... H04R 25/407

FOREIGN PATENT DOCUMENTS

EP 2360943 8/2011

OTHER PUBLICATIONS

Extended European Search Report for EP Patent Appln. No. 21162221.2 dated Aug. 13, 2021.

* cited by examiner

*Primary Examiner* — Tuan D Nguyen
(74) *Attorney, Agent, or Firm* — Vista IP Law Group, LLP

(57) ABSTRACT

A method performed by a first hearing device, includes: determining a first gain value, a second gain value, or both the first and second gain values; generating an intermediate signal including or based on a combination of the first directional input signal and the second directional input signal, wherein the first and second directional input signals in the combination are combined based on the first gain value, the second gain value, or both of the first and second gain values; and generating an output signal for the output unit based on the intermediate signal; wherein one or both of the first gain value and the second gain value are determined in accordance with an objective of making a proportion of the first directional input signal and a proportion of the second directional signal at least substantially equal.

29 Claims, 6 Drawing Sheets

HEARING DEVICES AND RELATED METHODS

FIELD

The file of the subject disclosure relates to hearing devices and methods.

BACKGROUND

People in general, and, in particular, people with a hearing loss, experience difficulties understanding speech in noisy environments.

Listening devices, e.g. including listening devices with compensation for a hearing loss, with directional sound capture (spatial filtering) is presently the best way to improve intelligibility of speech in noisy environments. In more technical terms the signal-to-noise ratio is improved. Use of directional microphones e.g. including beamforming methods involving multiple microphones e.g. arrays of multiple microphones on both sides of a user in an ipsilateral device and in a contralateral device, respectively, is a way to obtain directional sound capture. Beamforming microphone arrays in listening devices can improve the signal-to-noise ratio (SNR) and thus also speech intelligibility.

Unilateral beamformer arrays, also known as directional microphones, accomplish this improvement using two microphones in one listening device. Bilateral beamformer arrays, which combine information across four microphones in a bilateral fitting, further improve the SNR. Early bilateral beamformers were static with fixed attenuation patterns. Recently adaptive, bilateral beamformers have been introduced in commercial hearing aids.

There are various beamforming algorithms available to perform spatial filtering with microphones receiving sound waves differing only in time of arrivals. For listening devices, the acoustic wave, however, is filtered by the head before reaching to the microphones, which is often referred as the head shadow effect. The higher the sound frequency is, the stronger the head shadow effects. Generally, beamforming algorithms, which assumes free field propagation of sound waves, needs to be improved to appropriate compensate for the head shadow effect.

SUMMARY

It is observed that at least some users of hearing devices experience problems in situations where multiple target signal sources are present.

One problem, related to use of hearing devices with directional sensitivity, is that either directional sensitivity is engaged, which gives some useful advantages like spatial noise reduction, or that omnidirectional sensitivity is engaged to enable hearing from multiple directions. However, omnidirectional sensitivity usually comes at the cost of an increased noise level. When directional sensitivity is engaged, users have experienced a so-called 'tunnel effect'. That is, sounds from an on-axis target sound source are favoured in reproduction to the user at the cost of discriminating off-axis target sound sources. On axis sounds appear to be coming from a tunnel, while sounds from all other directions are dampened or completely excluded. This leads to a decreased spatial awareness for the user, and may, among other disadvantages, introduce listening fatigue and a reduced attention span. Furthermore, it is experienced that noise reduction obtained by conventional beamforming or directional microphones is not as good as desired.

In practice, this has led to a lack of acoustic fidelity and inconveniences for users, particularly in social settings, where a user may want to listen to—or be able to listen to more than one person in the vicinity, and at the same time enjoy reduction of noise from the surroundings. It is thus an objective to enhance the fidelity of a listening experience at least in some aspects or to reduce at least some of the undesired audiological effects associated with a hearing device based on a beamformed signal.

Generally, herein the term 'on-axis' refers to a direction, or 'cone' of directions, relative to one or both of the hearing devices at which directions the directional signals are predominantly captured from. That is, 'on-axis' refers to the focus area of one or more beamformer(s) or directional microphone(s). This focus area is usually, but not always, in front of the user's face, i.e. the 'look direction' of the user. In some aspects, one or both of the hearing devices capture the respective directional signals from a direction in front, on-axis, of the user. The term 'off-axis' refers to all other directions than the 'on-axis' directions relative to one or both of the hearing devices. The term 'target sound source' or 'target source' refers to any sound signal source which produces an acoustic signal of interest e.g. from a human speaker. A 'noise source' refers to any undesired sound source which is not a 'target source'. For instance, a noise source may be the combined acoustic signal from many people talking at the same time, machine sounds, vehicle traffic sounds etc.

The term 'reproduced signal' refers to a signal which is presented to the user of the hearing device e.g. via a small loudspeaker, denoted a 'receiver' in the field of hearing devices. The 'reproduced signal' may include a compensation for a hearing loss or the 'reproduced signal' may be a signal with or without compensation for a hearing loss. The wording 'strength' of a signal refers to a non-instantaneous level of the signal e.g. proportional to a one-norm (1-norm) or a two-norm (2-norm) or a power (e.g. power of two) of the signal.

The term 'ipsilateral hearing device' or 'ipsilateral device' refers to one device, worn at one side of a user's head e.g. on a left side, whereas a 'contralateral hearing device' or 'contralateral device' refers to another device, worn at the other side of a user's head e.g. on the right side. The 'ipsilateral hearing device' or 'ipsilateral device' may be operated together with a contralateral device, which is configured in the same way as the ipsilateral device or in another way. In some aspects, the 'ipsilateral hearing device' or 'ipsilateral device' is an electronic listening device configured to compensate for a hearing loss. In some aspects the electronic listening device is configured without compensation for a hearing loss. A hearing device may be configured to one or more of: protect against loud sound levels in the surroundings, playback of audio, communicate as a headset for telecommunication, and to compensate for a hearing loss.

The term 'processor' may include a combination of one or more hardware elements. In this respect, a processor may be configured to run a software program or software components thereof. One or more of the hardware elements may be programmable or non-programmable.

There is provided:

A method of processing an audio signal, comprising: at an ipsilateral hearing device (100) with: a first input unit (110) including one or more microphones (112, 113) and configured to generate a first directional input signal ($F_L$); a communications unit (120) configured to receive a second directional input signal ($F_R$) from a contralateral hearing device; an output unit (140); and a processor (130) coupled to: the first input unit (110), the communications unit (120) and the output unit (140):

determining one or both of a first gain value ($\alpha$; H(k)) and a second gain value ($1-\alpha$; 1–H(k));

generating an intermediate signal (V) including a combination of: the first directional input signal ($F_L$) and the second directional input signal ($F_R$), in accordance with one or both of the first gain value ($\alpha$; H(k)) and the second gain value ($1-\alpha$; 1–H(k));

wherein one or both of the first gain value ($\alpha$; H(k)) and the second gain value ($1-\alpha$; 1–H(k)) are determined in accordance with an objective of: making a proportion of the first directional input signal ($F_L$) and a proportion of the second directional signal ($F_R$) at least substantially equal when combined; and generating an output signal (Z) for the output unit (140) based on the intermediate signal.

Thereby, a significant improvement in acoustic fidelity is enabled at least when compared to methods involving selection between directionally focussed sensitivity and omnidirectional sensitivity. In particular improvements are achieved in social settings, where a user may want to listen to—or be able to listen to—more than one person in the vicinity, and at the same time enjoy reduction of noise from the surroundings.

In particular it is observed that the claimed method achieves a desired trade-off which enables a directional sensitivity, e.g. focussed at an on-axis target signal source, while at the same time enabling that an off-axis signal source to be heard, at least with better intelligibility. Listening tests has revealed that users experience less of a 'tunnel-effect' when provided with a system employing the claimed method.

Despite the undesired 'tunnel-effect' being suppressed or reduced, off-axis noise suppression is improved, as evidenced by an improved directionality index. This is also true, in situations where an off-axis target signal source is present.

Further, measurements show that a directivity index is improved over a range of frequencies, at least in the frequency range above 500 Hz and, in particular, in the frequency range above 1000 Hz.

The method enables that directionality of the hearing device can be maintained, despite the presence of an off-axis target sound source.

Rather than employing a method of entering an omnidirectional mode to capture the off-axis target sound source or alternatively suppressing the off-axis target sound source due to the directionality, a signal from an off-axis sound source is reproduced at the acceptable cost that the signals from an on-axis sound source is slightly suppressed, however only proportionally to the strength of signal from the off-axis sound source. Since the signals from an on-axis sound source are slightly suppressed, proportionally to the strength of signal from the off-axis sound source, the signals from the off-axis sound source can be perceived.

Thus, in some aspects, the method comprises forgoing automatically entering an omnidirectional mode. In particular, it is thereby avoided that the user is exposed to a reproduced signal in which the noise level increases when entering the omnidirectional mode.

At least in some aspects, the method is aimed at utilizing the head shadow effect on beamforming algorithms by scaling the first directional signal and the second directional signal. The scaling—or equalization of the first directional signal relative to the second directional signal or vice versa—is estimated from the first directional signal and the second directional signal.

The method can be implemented in different ways. In some aspects the first gain value and the second gain value are not frequency band limited i.e. the method is performed at one frequency band, which is not explicitly band limited. In other aspects, the first gain value and the second gain value are associated with a band limited portion of the first directional signal and the second directional signal. In some aspects, multiple first gain values and respective multiple second gain values are associated with respective band limited portions of the first directional signal and the second directional signal. In some aspects, the first gain value and the second gain value are comprised by respective arrays of multiple gain values at respective multiple frequency bands or frequency indexes, sometimes denoted frequency bins. In some aspects, prior to summation, the first gain value scales the amplitude of the first directional signal to provide a scaled first directional signal and the second gain value scales the amplitude of the second directional signal to provide a scaled second directional signal. Then the scaled first directional signal and the scaled second directional signal are combined by addition.

In other aspects, the first gain value scales the amplitude of the first directional signal to provide a scaled first directional signal, which is combined, by addition, with the second directional signal to provide a combined signal. Then, the combined signal is scaled by the second gain value. The method may include forgoing scaling by the second gain value.

In some aspects the intermediate signal is a single-channel signal or monaural signal. The Single channel signal may be a discrete time domain signal or a discrete frequency domain signal.

In some aspects the combination of the first directional input signal and the second directional input signal, is a linear combination.

As an illustrative example, the ipsilateral hearing device and the contralateral hearing device are in mutual communication, e.g. wireless communication, such that each of the ipsilateral hearing device and the contralateral hearing device are able to process the first directional input signal and the second directional input signal, wherein one of the directional signals is received from the other device. The signals may be streamed bi-directionally, such that the ipsilateral device receives the second directional signal from the contralateral device and such that the ipsilateral device transmits the first directional signal to the contralateral device. The transmitting and receiving may be in accordance with a power saving protocol.

As an illustrative example, the method is performed concurrently at the ipsilateral hearing device and at the contralateral hearing device. In this respect, the respective output units at the respective devices presents the output signals to the user as monaural signals. The monaural signals are void of spatial cues in respect of deliberately introduced time delays to add spatial cues.

In some examples, the output signal is communicated to the output unit of the ipsilateral hearing device.

As another illustrative example, each of the ipsilateral hearing device and the contralateral hearing device comprises one or more respective directional microphones or one or more respective omnidirectional microphones including beamforming processors to generate the directional signals.

As a further illustrative example, each of the first directional signal and the second directional signal is associated with a fixed directionality relative to the user wearing the hearing devices. Herein, an on-axis direction may refer to a direction right in front of the user, whereas an off-axis direction may refer to any other direction e.g. to the left side or to the right side. In some aspects, a user may select a fixed directionality, e.g. at a user interface of an auxiliary electronic device in communication with one or more of the hearing devices. In some embodiments, directionality may be automatically selected e.g. based on focusing on a strongest signal.

In some examples, the method includes combining the first directional signal and the second directional signal from monaural, fixed beamformer outputs of the ipsilateral device and the contralateral device, respectively, to further enhance the target talker.

The method may be implemented in hardware or a combination of hardware and software. The method may include one or both of time-domain processing and frequency-domain processing. The method encompasses embodiments using iterative estimation of the first gain value and/or the second gain value, and embodiments using deterministic computation of the first gain value and/or the second gain value.

In some aspects, the method is a method of processing an audio signal.

In some embodiments, the method comprises: recurrently determining one or both of: the first gain value ($\alpha$; H(k)) and the second gain value ($1-\alpha$; 1−H(k)) based on a non-instantaneous level of the first directional input signal ($F_L$) and a non-instantaneous level of the second directional input signal ($F_R$).

An advantage thereof is that less distortion and less hearable modulation artefacts are introduced when recurrently determining one or both of the first gain value ($\alpha$) and the second gain value ($1-\alpha$).

The non-instantaneous level of the first directional input signal and the non-instantaneous level of the second directional input signal may be obtained by computing, respectively, a first time average over an estimate of the power of the first directional input signal and a second time average over an estimate of the power of the first directional input signal. The first time average may be a moving average.

The non-instantaneous level of the first directional input signal and the non-instantaneous level of the second directional input signal may be proportional to: a one-norm (1-norm) or a two-norm (2-norm) or a power (e.g. power of two) of the respective signals.

The non-instantaneous level of the first directional input signal and the non-instantaneous level of the second directional input signal may be obtained by a recursive smoothing procedure. The recursive smoothing procedure may operate at the full bandwidth of the signal or at each of multiple frequency bins. For instance, in a frequency domain implementation, the recursive smoothing procedure may smooth at each bin across short time Fourier transformation frames e.g. by a weighted sum of a value in a current frame and a value in a frame carrying an accumulated average.

Alternatively, the non-instantaneous level of the first directional input signal and the non-instantaneous level of the second directional input signal may be obtained by a time-domain filter, e.g. an IIR filter.

In some embodiments, the method comprises: transforming the first directional input signal ($F_L$) and the second directional input signal ($F_R$) to a frequency domain by performing respective short-time Fourier transformations;

wherein the intermediate signal (V) and the output signal (Z) are generated in the frequency domain; and transforming the output signal (Z) from the frequency domain to a time-domain by performing short-time inverse Fourier transformation.

Thereby, the method can perform at least the generation of an intermediate signal, determination of the first gain value and the second gain value, and the generation of an output signal in the frequency domain. This enables a more efficient implementation, especially in connection with performing compensation for a hearing loss.

The Short-time Fourier transform, (STFT), is a Fourier-related transform used to determine the sinusoidal frequency and phase content of local sections of a signal as it changes over time. In practice, the procedure for computing STFTs is to divide a longer time signal into shorter segments of equal length and then compute the Fourier transform separately on each shorter segment. This reveals the Fourier spectrum on each shorter segment, denoted a frame. Each frame comprises one or more values in a number of so-called frequency bins.

In general, a sequence of a time domain signal which is transformed into the frequency domain by short-time Fourier transformation is denoted an analysis window. Also, in general, the time-domain signal generated by short-time inverse Fourier transformation is denoted a synthesis window.

The steps of transforming e.g. including the generation of the intermediate signal, as set out above, may be performed at a first recurring basis. The first recurring basis may relate to a sampling rate and a length of the analysis window, in number of samples. Thereby the steps of determining the first gain value and/or the second gain value and generating the intermediate signal and the output signal in the frequency domain can be performed when a recent frame is generated.

In some examples, the analysis window(s) is/are selected with a predefined overlap (in terms of samples or a relative duration) with respect to a previous analysis window. The overlap may be e.g. 50% of the length of the analysis window. Correspondingly, the overlap of the synthesis window may be 50% of the length of the synthesis window. The analysis window and the synthesis window may have the same lengths. At the overlapping portions, values of the synthesis window may be added to the values of previous synthesis window.

In some embodiments the first gain value and the second gain value are scalar values determined by an iterative method.

In some embodiments, the first gain value ($\alpha$; H(k)) and the second gain value ($1-\alpha$; 1−H(k)) are recurrently determined, subject to the constraint that the first gain value ($\alpha$; H(k)) and the second gain value ($1-\alpha$; 1−H(k)) sums to a predefined time-invariant value.

This constraint is useful to enable that the strength of a target signal in front, on-axis, is scaled proportionally to the strength of an off-axis signal. This is expedient to avoid disturbing an on-axis signal, which may be essential for the user to understand what a person in front, on-axis, is saying while ambient sounds change.

This constraint is also useful for a combination of the first directional signal and the second directional signal, wherein both of the first directional signal and the second directional signal are scaled in accordance with the first gain value and the second gain value, respectively, before the signals are combined into a single-channel signal. Also, this constraint is useful for an implementation of the method, wherein the first gain value and the second gain value are implemented as respective gain units, without at least deliberate frequency band limitations. In some embodiments, the first gain value ($\alpha$) and the second gain value ($1-\alpha$) are applied by respective gain stages without emphasis of a particular frequency range, i.e. without applying frequency dependent filtering.

In some aspects, the first gain value ($\alpha$) and the second gain value ($1-\alpha$) are determined, in accordance with an objective of: obtaining a substantially equal strength of the first directional input signal and the second directional input signal in the intermediate signal ($F_O$) subject to the constraint that the first gain value ($\alpha$) and the second gain value ($1-\alpha$) sums to a predefined time-invariant value.

In some aspects, the first gain value ($\alpha$) and the second gain value ($1-\alpha$) are determined, in accordance with an objective of: making a proportion of the first directional input signal ($F_L$) and a proportion of the second directional signal ($F_R$) at least substantially equal when combined, by the linear combination, subject to the constraint that the first gain value ($\alpha$) and the second gain value ($1-\alpha$) sums to a predefined time-invariant value As an illustrative example, a sum of the first gain value ($\alpha$) and the second gain value ($1-\alpha$) is constrained to add up to a fixed constant value, which remains constant at least over a period of time when recurrent control of the gain values take place.

In some embodiments, the first gain value ($\alpha$; H(k)) and the second gain value ($1-\alpha$; 1−H(k)) are determined further in accordance with minimizing an auto-correlation or cross power spectrum of the intermediate signal (V).

Thereby the method is beneficial in terms of improved noise reduction in addition to the improved spatial noise reduction. In particular, a noise signal source emitting a signal, even a strong signal, which correlates only poorly between the first input signal and the second input signal is suppressed.

In some embodiments, one or both of the first gain value ($\alpha$; H(k)) and the second gain value ($1-\alpha$; 1−H(k)) are recurrently estimated in accordance with adaptively seeking to minimize a first cost function C($\alpha$, $\beta$), wherein the cost function includes the mean value of: the sum of: the first gain value ($\alpha$; H(k)) multiplied by a numeric value representation of the first directional signal ($F_L$) and the second gain value ($1-\alpha$; 1−H(k)) multiplied by a numeric value representation the second directional signal ($F_R$).

Thereby it is ensured that the signal strength of an on-axis target signal source scales proportionally to the signal strength of an off-axis target signal source and thus that the off-axis target signal source does not drown out the on-axis signal source. Also, it is ensured that the on-axis target signal is maintained at even proportions at both ears of a user in case a pair of hearing devices are worn simultaneously by the user.

The step of adaptively seeking to minimize a first cost function may be implemented using a Least-Means-Square algorithm or another gradient descent algorithm known in the art.

The numeric value representation may also be designated an absolute value representation or an unsigned value representation. The mean value may be a one-norm or a two-norm or a power (e.g. a power of two). The mean value may be a Root-Mean-Square, rms, value. As an example, the first cost function may thus include the term:

$$S=\text{argmin}(\text{rms}(\alpha F_L+(1-\alpha)F_R)$$

wherein $F_1$ represents the first signal, $F_2$ represents the second signal, a represents the first gain value, $1-\alpha$ represents the second gain value, rms( ) represents a function for computing the Root-Mean-Square, and argmin( ) represents a function for reaching a minimum value. This is equivalent to solving for $\alpha$ and $\beta$ in the following cost functions C($\alpha$,$\beta$):

$$\text{Argmin}(E(\alpha F_L+\beta F_R)\cdot(\alpha F_L+\beta F_R)^*)$$

under the constraints $\alpha+\beta=1$ and E is statistical expectation. * indicates the conjugation of a complex function.

The step of adaptively seeking to minimize a cost function may be performed on a recurrent basis, e.g. denoted a second recurrent basis. The second recurrent basis may be different from the first recurrent basis. The second recurrent basis may be more frequent than the first recurrent basis. Thus, following an iteration period, at least a most recent value of the first gain value ($\alpha$) or a most recent value of the second gain value ($1-\alpha$) is determined adaptively. The intermediate signal is then computed based at least on the most recent value.

In some embodiments, the constraint that the first gain value ($\alpha$; H(k)) and the second gain value ($1-\alpha$; 1−H(k)) sums to a predefined time-invariant value is included in the first cost function.

Thereby an efficient, iterative way of determining the first gain value and the second gain value is enabled.

The cost function may be determined and minimized in accordance with the method of Lagrange multipliers, which is a strategy for finding the local maxima and minima of a cost function subject to equality constraints, wherein the equality constraints include the constraint that the first gain value ($\alpha$) and the second gain value ($1-\alpha$) sums to a time-invariant value.

The cost function may then be formulated as:

$$C(\alpha,\beta)=\{E\{(\alpha F_L+\beta F_R)\cdot(\alpha F_L{}^*+\beta F_R{}^*)\}+\lambda^*(\alpha+\beta-1)+\lambda(\alpha+\beta-1)^*$$

wherein $\lambda$ is the Lagrange multiplier.

In some embodiments, the method comprises:

iteratively, in the frequency domain:

determining an updated first gain value ($\alpha$, H(k)) based on a previous first gain value and an iteration step size multiplied by a difference between the first directional signal ($F_L$) and the second directional signal ($F_R$), and a ratio between the value of the intermediate signal (V) and a squared value (V*V) of the intermediate signal (V):

determining an updated value ($V_{n+1}$) of the intermediate signal (V) including a linear combination of the first directional input signal ($F_L$) and the second directional input signal ($F_R$), based on the updated first gain value ($\alpha$, H(k)) and the updated second gain value ($1-\alpha$, 1−H(k)).

Thereby an efficient, albeit iterative implementation is achieved. When the updated value of the intermediate signal has been determined, based on the updated first gain value ($\alpha$) and the updated second gain value ($1-\alpha$), the output signal for the output unit is generated. The steps of determining an updated first gain value ($\alpha$), and determining an updated value ($V_{n+1}$) of the intermediate signal V, are thus performed in the frequency domain.

An initial value of the intermediate signal, V, may be based on a value of the intermediate signal obtained at a preceding frame. A first time value of the intermediate signal may include a mean value of the strength of the first directional signal and the strength of the second directional signal.

In some embodiments the first gain value and the second gain value are frequency dependent gain values, H(k); 1−H(k), determined by a non-iterative, non-recursive method.

In some embodiments, one or both of the first gain value ($\alpha$; H(k)) and the second gain value ($1-\alpha$; 1−H(k)) is/are a frequency dependent gain of a first filter (H) and a second filter (1−H), respectively.

The first filter H and/or the second filter 1−H enables a frequency dependent improvement in terms of maintaining noise reduction while improving the directionality index associated with the output signal.

The filters may be implemented as frequency-domain filters or a time-domain filters.

In some embodiments, the method comprises: transforming the first directional input signal ($F_L$) and the second directional input signal ($F_R$) to the frequency domain by performing respective short-time Fourier transformations;

generating the intermediate signal, based on one or both of: a first filter (H) and a second filter (1−H), and the output signal, in the frequency domain; and transforming the output signal from the frequency domain to a time-domain by performing short-time inverse Fourier transformation;

wherein one or both of: the first filter (H) and the second filter (1−H) are zero-phase filters.

Thus, in some examples, one or both of the first filter H and the second filter 1−H are phase-neutral filters or zero-phase filters, wherein the first filter and the second filter are applied to frames of a frequency-domain transformation of the first directional signal and the second directional signal.

In some embodiments, the method comprises:

determining the power spectrum ($P_L$) of the first directional input signal ($F_L$) and the power spectrum ($P_R$) of the second directional input signal ($F_R$) for multiple or each of multiple frequency indexes (k):

determining a minimum value ($P_N$) and a maximum value ($P_X$) at a frequency index (k) among the values of the power spectrum ($P_L$) of the first directional input signal ($F_L$), the power spectrum ($P_R$) of the second directional signal ($F_R$);

determining a first filter value (H(k)) of a first filter (H) in accordance with a predetermined algebraic relation between a minimum value ($P_N$(k)) and a maximum value ($P_X$(k));

determining a frequency spectrum (F) of the intermediate signal (V) based on the first filter (H) and a frequency spectrum of the first directional input signal ($F_L$) and a frequency spectrum of the second directional input signal ($F_R$).

This method enables a non-recursive estimation of the first filter, H, rather than an iterative, time-consuming and less predictable determination of the first filter. Thus, at least in some examples, fewer hardware resources are required compared to a recursive method. The non-recursive estimation of the first filter may provide a less accurate determination of the first filter compared to an optimal first filter. However, listening tests have revealed an improvement on par with a recursively optimized first filter.

In some embodiments, the method comprises:

determining the cross-power spectrum (PLR) of the first directional signal and the second directional signal;

for each or multiple of the frequency indexes (k):

determining a second filter value (G(k)) of a second filter (G) in accordance with a ratio between a value ($P_{LR}$(k)) of the cross-power spectrum ($P_{LR}$) and the sum of: a value ($P_L$(k)) of the power spectrum ($P_L$) of the first directional input signal ($F_L$) and a value ($P_R$(k)) the power spectrum ($P_R$) of the second directional input signal ($F_R$);

determining a frequency spectrum (V) of the intermediate signal further based on the second filter (G).

Thereby a post-filter, G, is provided to further filter the signal output by the equalization unit or equalization filter, H. In this respect, the post filter, G, further improves the directional index as evidenced herein.

In some embodiments, the method comprises:

filtering the single-channel signal with a single channel post-filter (G) which is configured to suppress an off-axis signal component in the single-channel signal, relative to an on-axis signal component; wherein the off-axis signal component occurs out-of-phase in the first directional input signal ($F_L$) and the second directional signal ($F_R$); and wherein the on-axis signal component occurs in-phase in the first directional input signal ($F_L$) and the second directional input signal ($F_R$).

Thereby, off-axis signal sources are suppressed in addition to any suppression of off-axis signal sources in one or both of: the first directional signal and the second directional signal. Thus, a post-filter transfer function is obtained to suppress influence of a sound source outside of the beam focus and thus enhanced noise reduction compared to noise reduction obtained by beamforming alone. The post-filter may be a Wiener filter.

Moreover, a post-filter transfer function is obtained to further suppress the influence of any sound source outside of the beam focus.

In particular, when a post-filter is included, it is observed that the claimed method achieves a desired trade-off which enables directionally focussed sensitivity, e.g. focussed at an on-axis target signal source, while at the same time enabling that an off-axis signal source can be perceived, at least with better intelligibility, whereas noise signal sources from off-axis signal sources is suppressed.

Listening tests have revealed that users perceive improved noise suppression, while they experience less of a 'tunnel-effect'. Further, measurements show that a directivity index is improved over a range of frequencies, at least in the range above 500 Hz and in particular in the range above 1000 Hz. Despite the fact that the undesired 'tunnel-effect' is suppressed or reduced, off-axis noise suppression is improved, as evidenced by an improved directionality index. This is also true, in situations where an off-axis target signal source is present.

In some embodiments, the method comprises: processing the intermediate signal (V) based on a hearing loss compensation, which modifies the output signal (Z) in accordance with a predetermined hearing loss.

Thereby, perceived directionality is improved for a wearer of the hearing device. In some examples, an ipsilateral hearing device and a contralateral hearing device are configured with respective hearing loss compensations, which modify respective output signals at a left ear and a right ear in accordance with a predetermined hearing loss for the respective ear.

In some embodiments, the method comprises: generating a further output signal, at least substantially equal to the output signal (Z); wherein the further output signal is communicated to an output unit of the contralateral hearing device; and wherein the output signal and the further output signal constitutes a monaural signal at least substantially.

In some examples, the output signal, obtained as described above, is presented to the user at both ears. Advantages of the first mode are described above. As an additional advantage, e.g. to improve speech intelligibility, the output signal is presented to the user at both ears.

In some embodiments, the combination is a linear combination. The combination is a linear combination in amplitude. Expediently, distortion artefacts can be substantially avoided.

In some embodiments, the combination is determined at least by the sum of: the first directional input signal ($F_L$) scaled in accordance with the first gain value ($\alpha$); and the second directional input signal ($F_R$) scaled in accordance with the second gain value ($1-\alpha$).

Thereby the intermediate signal, V, includes a linear combination of the first directional input signal ($F_L$) and the second directional input signal ($F_R$). Expediently, distortion artefacts can be substantially avoided.

There is also provided:

A hearing device (100), comprising:

a first input unit (110) including one or more microphones (112, 113);

a communications unit (120);

an output unit (140) comprising an output transducer (141);

at least one processor (130) coupled to: the first input unit (110), the communications unit (120) and the output unit (140); and a memory storing at least one program, wherein the at least one program is configured to be executed by the one or more processors, the at least one program including instructions for performing the method of any of claims 1-17.

The hearing device may be an ipsilateral hearing device configured to communicate, e.g. bi-directionally, with a contralateral hearing device. In some examples the ipsilateral hearing device is configured to be worn at or in a left ear of a user, whereas the contralateral hearing device is configured to be worn at or in a right ear of the user, or vice versa.

In some examples, the ipsilateral hearing device is a wearable electronic device. In some examples, the contralateral hearing device is a wearable electronic device.

There is also provided a hearing system comprising an ipsilateral hearing device and a contralateral hearing device. One or both of the ipsilateral hearing device and the contralateral hearing device are configured as set out in any of the above embodiments and/or aspects and/or examples.

In some examples, the hearing system comprises an auxiliary electronic device. In some examples, the auxiliary electronic device is configured as a remote control.

There is also provided:

A computer readable storage medium storing at least one program, the at least one program comprising instructions, which, when executed by the at least one processor of a hearing device (100) with an input transducer, at least one processor and an output transducer (141), enables the hearing device to perform the method as set out in any of the above embodiments and/or aspects and/or examples.

The subject matter described herein may be implemented in software, in combination with hardware. For example, the subject-matter described herein may be implemented in software executed by a processor. In one exemplary implementation, a method described herein may be implemented using a non-transitory computer readable medium having stored thereon executable instructions that when executed by the processor of a computer, control the processor to perform steps of the method. Exemplary non-transitory computer readable media suitable for implementing the subject-matter described herein include a memory device, e.g. a memory device accessible by a processor device, a processor device, programmable logic devices, and application specific integrated circuits.

In some examples, the computer readable storage medium is a memory portion of a processor e.g. in a hearing device or in another type of electronic device such as, but not limited to, a smartwatch, a smartphone and a tablet computer. In some examples, the computer readable storage medium is a portable memory device.

There is also provided a method at an ipsilateral, hearing device (100) with: a first input unit (110) including one or more microphones (112, 113) and configured to generate a first directional input signal ($F_L$); a communications unit (120) configured to receive a second directional input signal ($F_R$) from a contralateral, hearing device; an output unit (140); and a processor (130) coupled to: the first input unit (110), the communications unit (120) and the output unit (140):

generating an intermediate signal (V) including a combination of: the first directional input signal ($F_L$) and the second directional input signal ($F_R$), in accordance with one or both of: a first filter transfer function (H) and a second filter transfer function (1−H);

generating a first power spectrum based on the first directional input signal ($F_L$) and the second directional input signal ($F_R$);

generating a cross power spectrum ($P_{LR}$) based on the first directional input signal ($F_L$) and the second directional input signal ($F_R$);

for one or more frequency bands (k): determining a lowest value ($P_N$) and a highest value ($P_X$) among an estimated power value of the first directional input signal ($F_L$) and an estimated power value of the second directional input signal ($F_R$);

generating an equalization filter (H) with gain values, which, for at least multiple frequency bands (k) is based on a predetermined algebraic relation between the minimum value ($P_N$) and the maximum value ($P_X$);

generating a first filtered signal by:

filtering the first directional input signal ($F_L$) by first the equalization filter (H) prior to combining the first filtered signal and a signal based on the second directional input signal ($F_R$); or filtering the second directional input signal with the equalization filter (H) prior to combining the second filtered signal and a signal based on the first directional input signal; and generating the output signal by combining: the first filtered signal and a signal based on the second directional input signal.

In some examples the predetermined algebraic relation is a ratio or a root of the ratio.

BRIEF DESCRIPTION OF THE FIGURES

A more detailed description follows below with reference to the drawing, in which.

DETAILED DESCRIPTION

Figure 1:
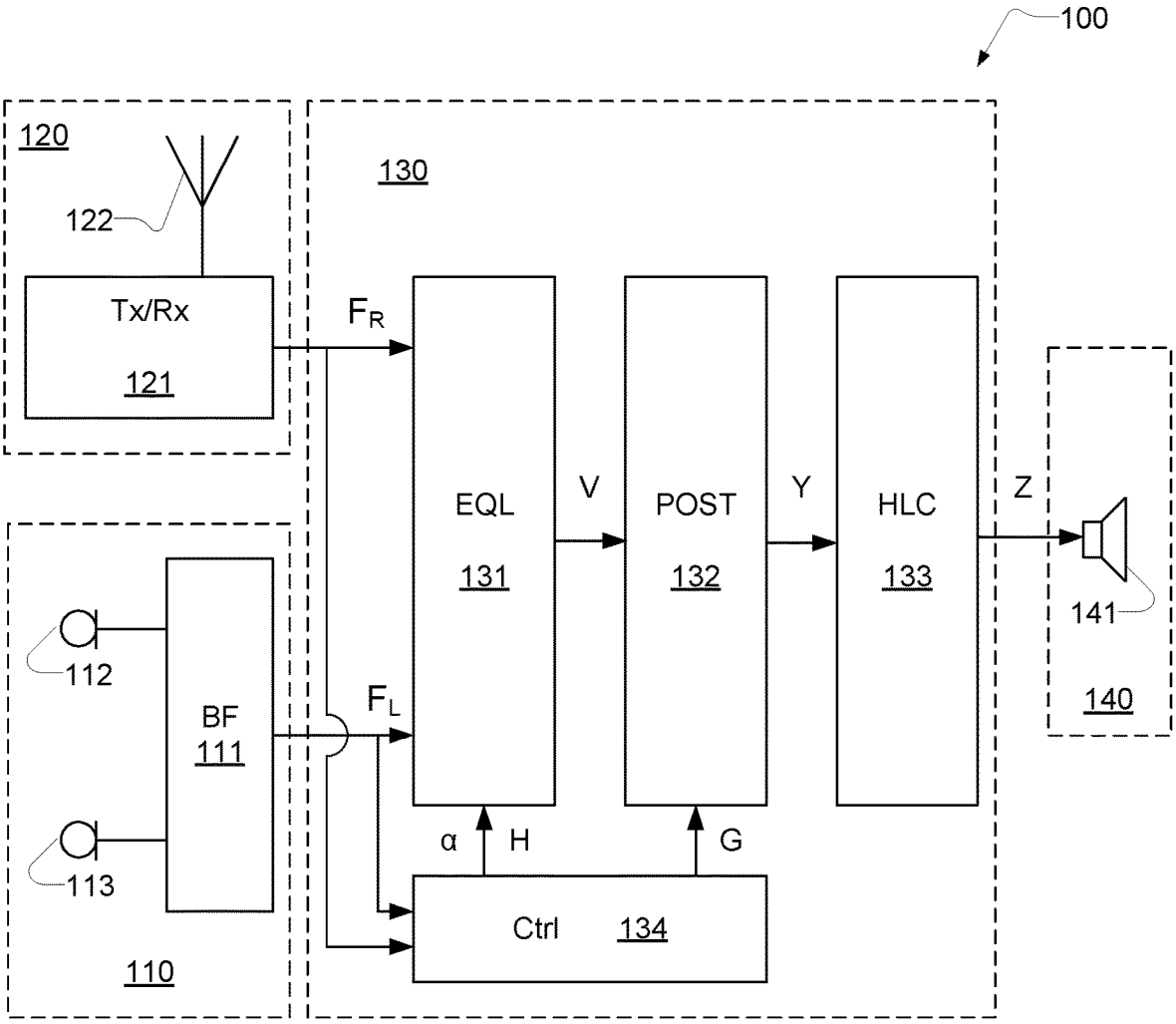
FIG. 1 shows an ipsilateral hearing device with a communications unit for communication with a contralateral hearing device.

Various embodiments are described hereinafter with reference to the figures. Like reference numerals refer to like elements throughout. Like elements will, thus, not be described in detail with respect to the description of each figure. It should also be noted that the figures are only intended to facilitate the description of the embodiments. They are not intended as an exhaustive description of the claimed invention or as a limitation on the scope of the claimed invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

FIG. 1 shows an ipsilateral hearing device with a communications unit for communication with a contralateral hearing device (not shown). The ipsilateral hearing device 100 comprises a communications unit 120 with an antenna 122 and a transceiver 121 for bidirectional communication with the contralateral device. The ipsilateral hearing device 100 also comprises a first input unit 110 with a first microphone 112 and a second microphone 113 each coupled to a beamformer 111 generating a first directional signal $F_L$. In some examples, the beamformer is a hyper-cardioid beamformer.

The communications unit 120 receives a second directional signal $F_R$. At the contralateral device, the second directional signal $F_R$ may be captured by an input unit corresponding to the first input unit 110. In some examples, the second directional signal $F_R$ is a frequency domain signal. In some examples, the first directional signal, $R_L$, is a frequency domain signal. In some examples, the beamformer 111 performs beamforming in the frequency domain or a short time frequency domain.

For convenience, the first directional signal, $F_L$, and the second directional signal, $F_R$, are denoted an ipsilateral signal and a contralateral signal, respectively. Although, time domain to frequency domain transformation, e.g. short time Fourier transformation (STFT), and corresponding inverse transformations, e.g. short time inverse Fourier transformation (STIFT), may be used, such transformations are not shown here. In general capital reference letters, e.g. F, V, Y and Z represent frequency-domain signals. Capital reference letters, e.g. H and G, represent frequency-domain transfer functions. Subscripts, e.g. L and R are used to designate that a signal is from an ipsilateral device and a contralateral device respectively. In some examples, a first device, e.g. the ipsilateral device, is positioned and/or configured for being positioned at or in a left ear of a user. In some examples, a second device, e.g. a contralateral device, is positioned at or in a right ear of the user. The first device and the second device may have identical or similar processors. In some examples one of the processors is configured to operate as a master and another is configured to operate as a slave.

The first directional signal $F_L$ and the second directional signal $F_R$ are input to a processor 130 comprising an equalization unit 131. The equalization unit 131 may be based on gain units or filters as described in more detail herein. The equalization unit 131 equalizes the strength or amplitude of the first directional signal $F_L$ and the strength or amplitude of the second directional signal $F_R$ prior to summation. Thus, two equalized signals are added. The equalization unit 131 outputs an intermediate signal V. In some examples the equalization unit 131 outputs a single-channel intermediate signal V. In some examples, the single-channel intermediate signal is a monaural signal.

In some embodiments the equalization unit is based on gain stages. In this respect, the equalization unit 131 performs equalization of the input signals to equalize their strength or amplitude based on one or more gain factor values including a gain value $\alpha$.

In other embodiments, the equalization unit is based on filters. In this respect, the equalization unit 131 performs equalization of the input signals to equalize their strength or amplitude, individually, at each of multiple frequency bands or frequency bins based on one or more gain filter transfer functions including filter transfer function H.

The one or more gain factor values including a gain value $\alpha$ or the one or more gain filter transfer functions including filter transfer function H are determined, as described in more detail herein, by a controller 134. The controller 134 is coupled to the processor 130 and one or both of the equalizing unit 131 and a post-filter 132. The controller 134 determines one or more of: the gain value, $\alpha$, an equalization filter transfer function H and a post-filter transfer function G.

The output, V, from the equalization unit 131 is input to the post-filter 132 which outputs an intermediate signal Y. In some embodiments the post-filter 132 is integrated with the equalization filter 131. In some embodiments the post-filter 132 is omitted or at least temporarily dispensed with or by-passed.

In some embodiments, the intermediate signals V or Y is input to a hearing loss compensation unit 133, which includes a prescribed compensation for a hearing loss of a user as it is known in the art. In some embodiments, the hearing loss compensation unit 133 is omitted or by-passed.

The intermediate signal V or Y or Z is input to an output unit 140, which may include a so-called 'receiver' or a loudspeaker 141 of the ipsilateral device for providing an acoustical signal to the user. In some embodiments the intermediate signal V or Y or Z is input to a second communications unit for transmission to a further device. The further device may be a contralateral device or an auxiliary device.

Figure 2:
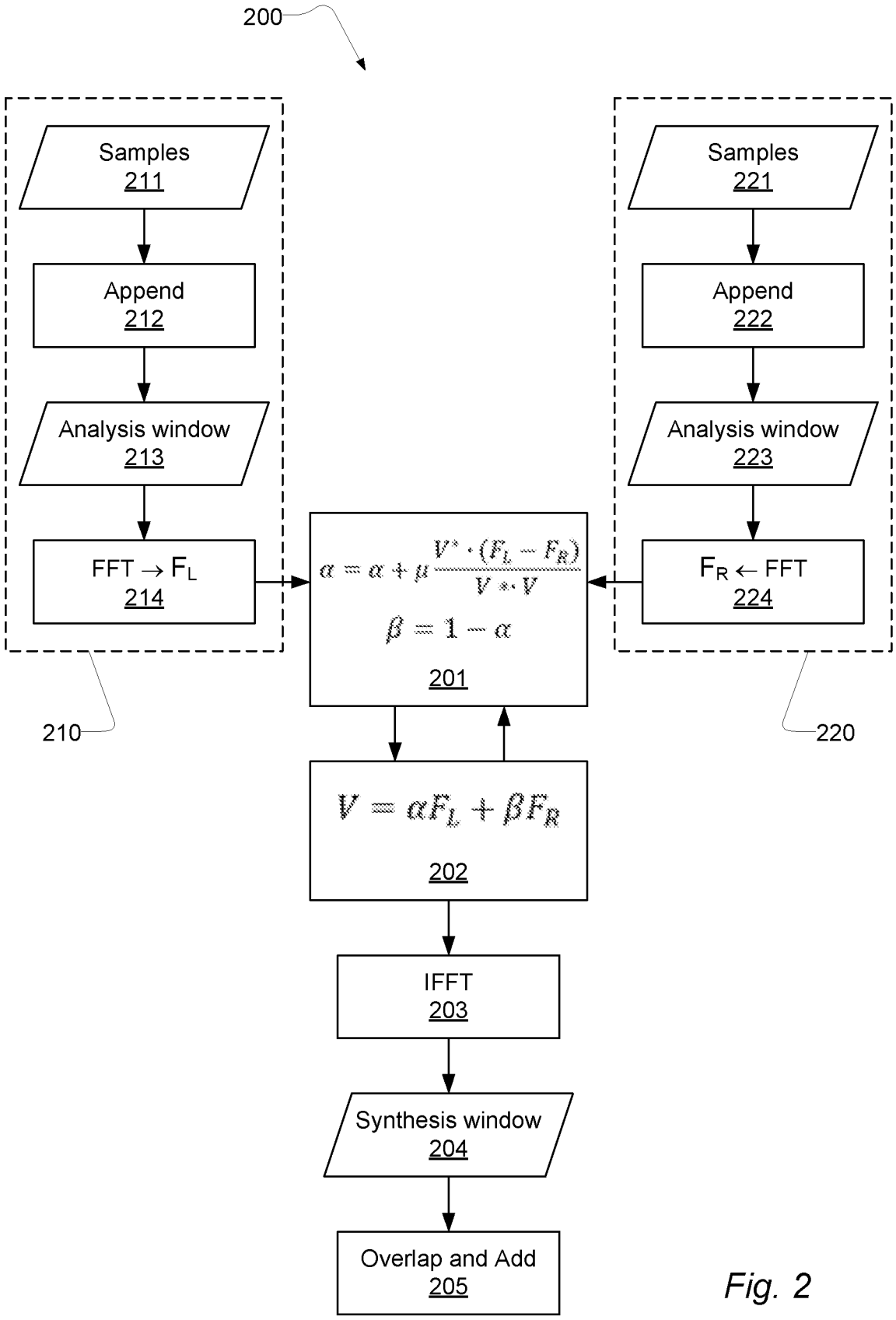
FIG. 2 shows a first embodiment of a method performing equalization.

More details about the processing included is given below: FIG. 2 shows a first embodiment of a method 200 performing equalization. The first embodiment is based on a recurrent determination of the first gain value and the second gain value. The first gain value, $\alpha$, and the second gain value, $1-\alpha$, are adaptively determined e.g. in accordance with the following. The first gain value and the second gain value are applied to equalize the strength of the first directional signal (the ipsilateral signal) and the second directional signal (contralateral signal) prior to combination e.g. by summation.

Figure 4:
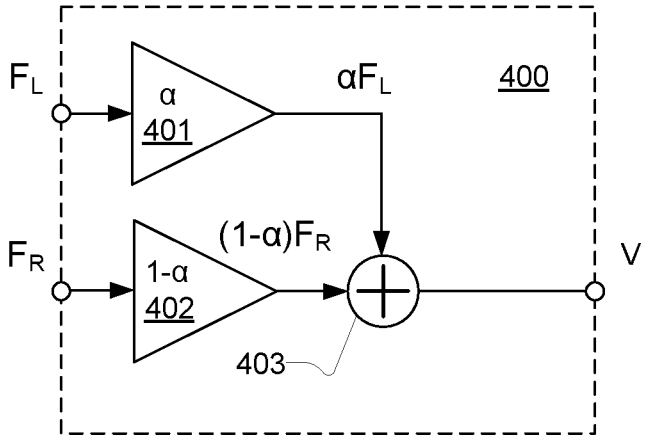
FIG. 4 shows a first equalization unit based on gain stages.

The ipsilateral signal and the contralateral signal are firstly equalized and then combined with the objective of enhancing the strength of an on-axis target signal e.g. from a person speaking to the user from a position, on-axis, in front of the user. One way to express this objective is:

$$S=\text{argmin}(\text{rms}(\alpha F_L+(1-\alpha)F_R)$$

wherein rms represents a function computing the root mean square and argmin is a function seeking a minimum by optimization of a, which serves as a variable value while determination of the gain value takes place. An optimal value of a serves the objective of equalizing the strength of the first directional signal (the ipsilateral signal) and the second directional signal (contralateral signal) prior to summation. FIG. 4 shows an example of how to equalize the signals prior to summation.

For a recurrent determination of the first gain value and the second gain value, the following cost function, C (α,β), may be defined:

$$C(\alpha,\beta)=\{E\{(\alpha F_L+\beta F_R)\cdot(\alpha F_L^*+\beta F_R^*)\}+\lambda^*(\alpha+\beta-1)+\lambda+(\alpha+\beta-1)^*$$

This cost function includes the above objective, S, and includes the constraint α+β=1 using the Lagrange method with Lagrange multiplier λ. The symbol '*' denotes the complex conjugate.

An optimal solution can be obtained by minimizing the above cost function C(α,β) in accordance with a steepest descent algorithm. In one example, the steepest descent algorithms are as follows:

Take Gradient:

$$\nabla C=\begin{pmatrix} E\{F_L\cdot V^*) & + & \lambda^* \\ E\{F_R\cdot V^*) & + & \lambda^* \end{pmatrix}$$

Solve Lagrange:

$$\lambda=-\frac{1}{2}(E\{F_R^*\cdot V\}+E\{F_L^*\cdot V\})$$

Compute: $V=\alpha F_L+\beta F_R$

Therefore the gradient is $$\nabla C=\frac{1}{2}\begin{Bmatrix} E\{V^*\cdot F_L\} & -E\{V^*\cdot F_R\} \\ E\{V^*\cdot F_R\} & -E\{V^*\cdot F_L\} \end{Bmatrix}$$

The least mean square (LMS) solution is:

$$\begin{pmatrix} \alpha_{n+1} \\ \beta_{n+1} \end{pmatrix}=\begin{pmatrix} \alpha_n \\ \beta_n \end{pmatrix}-\mu\cdot\frac{1}{2}\begin{Bmatrix} E\{V^*\cdot F_L\} & -E\{V^*\cdot F_R\} \\ E\{V^*\cdot F_R\} & -E\{V^*\cdot F_L\} \end{Bmatrix}$$

μ is the step size

The normalized least mean square (NLMS) algorithm can be described as:

$$\begin{pmatrix} \alpha_{n+1} \\ \beta_{n+1} \end{pmatrix}=\begin{pmatrix} \alpha_n \\ \beta_n \end{pmatrix}-\mu\cdot\frac{1}{2}\begin{Bmatrix} \{V^*\cdot(F_L-F_R)\} \\ \{V^*\cdot(F_R-F_L)\} \end{Bmatrix}\Big/\{V^*\cdot V\}$$

The update is performed when $V^*\cdot V>0$. The step size default may be μ=0.001, which determines the convergence rate. Other values of μ may be used. Also, μ may be varied dynamically during minimizing the cost function.

The first embodiment is implemented as shown in FIG. 2. The first embodiment includes steps 210 to transform the ipsilateral signal from a time-domain to a frequency domain. In some aspects, if the ipsilateral signal is in accordance with a frequency domain representation, the steps 210 may be dispensed with, at least in this portion of the method. For example, if the ipsilateral signal is output from a directional microphone or a beamformer in the time domain, steps 210 can be used to perform the transformation to the frequency domain. If the beamformer, e.g. beamformer 111, outputs a frequency domain signal, steps 210 may be omitted.

Correspondingly, steps 220 transform the contralateral signal from a time-domain to a frequency domain. Correspondingly, in some aspects, if the contralateral signal is in accordance with a frequency domain representation, the steps 220 may be dispensed with, at least in this portion of the method. This may be the case if the contralateral signal is received from a contralateral device in an accordance with a frequency domain representation.

The steps 210 and 220 may be performed in the same way at the ipsilateral device. Alternatively, steps 210 may be performed at the ipsilateral device and steps 220 may be performed at the contralateral device. At step 211 time domain samples from a first input device, e.g. first input device 120, are received. These time domain samples are appended at step 212 to a sequence of previously received input samples to form an analysis window of e.g. 48 samples at step 213. At step 210 a short time Fourier transformation is performed based on the analysis window to provide a frequency domain signal $F_L$. $F_L$ may be represented by real values or complex values in a vector or a frame with a number of k bins, e.g. 48 bins. Each bin may comprise one or more values. In a similar manner, steps 221, 222, 223 and 224 generates the contralateral signal $F_R$.

Based on signals $F_L$ and $F_R$, and the gradient VC, updated values of a and thus β=1−α can be computed in step 201. Updated values of a is computed in accordance with:

$$\alpha=\alpha-\mu\frac{V^*\cdot(F_L-F_R)}{V^*\cdot V}$$

In step 202, V is updated in accordance with $V=\alpha F_L+\beta F_R$. The method may recurrently perform steps 201 and 202 until a stop criterion is reached. In some examples, a stop criterion is that a predefined number of iterations are performed. In other examples, a stop criterion is that the gradient flattens out or that a converges towards a value.

Subsequently, in step 203, a short time inverse Fourier transformation (IFFT) is computed based on v when the recurrent method is completed. As a result, a synthesis window of e.g. 48 time domain samples are generated. The time domain samples may partially overlap previously generated time domain samples. At the overlap, sample values are added.

As a result, $\alpha F_L$ and $\beta F_R$ are equalized in terms of strength before being combined.

A second embodiment, described below, equalizes the strength of the signals without relying on recursive estimation.

Figure 3:
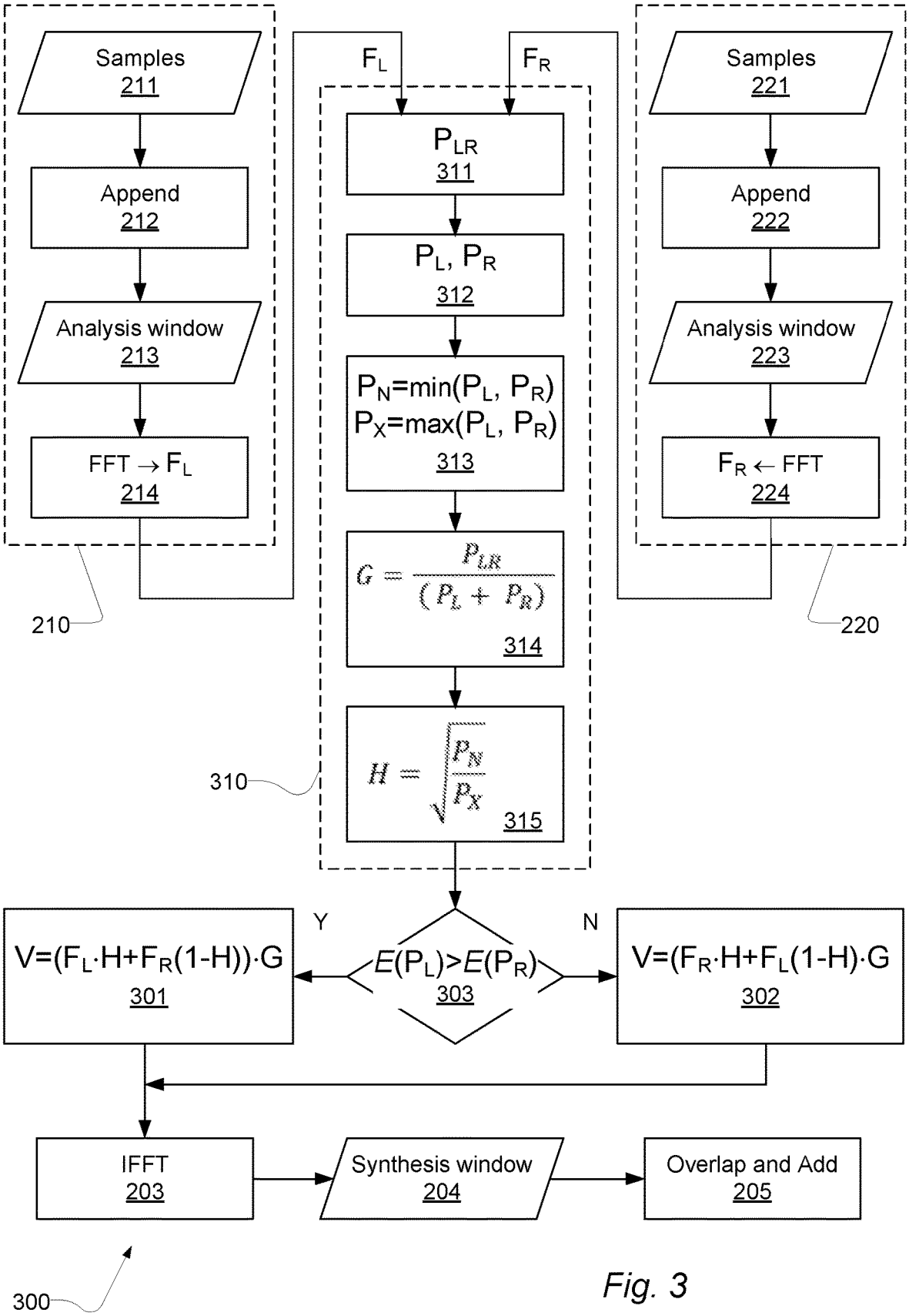
FIG. 3 shows a second embodiment of a method performing equalization.

FIG. 3 shows a second embodiment of a method performing equalization. The method 300 uses steps 210 and 220 as described above to obtain signals $Z_L$ and $Z_R$. The method performs steps 310, which may be non-iterative steps, before generating the intermediate signal V at step 301 or step 302. At step 311 the cross power spectrum $P_{LR}$ of $F_L$ and $F_R$ is computed. At step 312, the power spectrum $P_L$ of $F_L$ is computed, and the power spectrum $P_R$ of $F_R$ is computed. The power spectra and cross power spectrum are generated for a number of frequency bins or indexes designated k. As an example, in the case of 48 frequency bins, k is in the range of [1, 48]. In the frequency domain, the signals may include a frame with a number of frequency bins. Each bin may comprise one or more values. A frame may include fewer or more than 48 frequency bins e.g. 24 or 96 frequency bins.

At step 313, the minimum power spectrum value $P_N(k)$ in the set of power spectrum values $\{P_R(k); P_L(k)\}$ is determined for each or multiple of the frequency bins. Also, at step 313, the maximum power spectrum value $P_X(k)$ in the set of power spectrum values $\{P_R(k); P_L(k)\}$ is determined for each or multiple of the frequency bins. Thus, subscript N designates the minimum values and subscript X designates the maximum values. As a result, vectors or frames $P_N$ and $P_X$ including minimum values and maximum values, respectively, are generated. Determining the minimum power spectrum value, $P_N(k)$, and determining the maximum power spectrum value, $P_X(k)$ is based on comparing the magnitude of $P_R(k)$ and $P_L(k)$. At step 314, a transfer function G for a post-filter is computed based on the cross power spectrum $P_{LR}$ of $Z_L$ and $F_R$ and the power spectrum $P_R$ of $F_R$. In one example, the transfer function G is computed as follows:

$$\text{Post filter: } G = \frac{P_{LR}}{(P_L + P_R)}$$

wherein the real value, Re(G), of G is used for the post-filter or the real value, $Re(P_{LR})$, of $P_{LR}$ is used when computing G. Thus, in one example:

$$\text{Post filter: } G = \frac{Re(P_{LR})}{(P_L + P_R)}$$

At step 315, a transfer function H is computed for an equalization filter based on $P_N$ and $P_X$ including minimum values and maximum values, respectively, as described above. In one example, the transfer function H is computed as follows:

$$\text{Equalizer filter: } H = \sqrt{\frac{P_N}{P_X}}$$

H is per definition a real-valued transfer function.

H and G are computed element-wise for each frequency bin k.

Subsequently, at step 303, the method includes determining that either the ipsilateral signal, $F_L$, is strongest (Y) or determining that the contralateral signal, $F_R$, is the strongest (N). The determination may be based on a measure of energy, E, across all frequency bins, k, in the power spectra. $E(P_L)$ and $E(P_R)$ are thus scalar values.

In response to determining that the contralateral signal, $F_R$, is the strongest (N), the method proceeds to step 301, wherein V is computed in accordance with the following expression:

$$V=(F_L*H+F_R*(1-H))*G$$

Thus, $F_L$ is scaled by filter H to be equalized to $F_R$ before summation. The post-filter transfer function G is applied to the sum.

Alternatively, in response to determining that the ipsilateral signal, $F_L$, is the strongest (Y) the method proceeds to step 302 wherein V is computed in accordance with the following expression:

$$V=(F_R*H+F_L(1-H))*G$$

Thus, $F_R$ is scaled by filter H to be equalized to $F_L$ before summation. The post-filter transfer function G is applied to the sum.

In some examples, the post-filter is omitted or temporarily dispensed with. V is then computed in accordance with the following expressions:

$$V=(F_L*H+F_R*(1-H)) \text{ or } V=(F_R*H+F_L(1-H))$$

wherein G is omitted.

In some examples, one or more of the power spectra, $P_L$ and $P_R$, and the cross-power spectrum, $P_{LR}$, is/are estimated using a recursive smoothing method. A recursive smoothing method may be in accordance with one or more of the below recursive expressions:

$$P_L(\omega,n+1)=\gamma P_L(\omega,n)+(1-\gamma)F_L(\omega,n)*F^*_L(\omega,n)$$

$$P_r(\omega,n+1)=\gamma P_R(\omega,n)+(1-\gamma)F_R(\omega,n)*F^*_R(\omega,n)$$

$$P_{LR}(\omega,n+1)=\gamma P_{LR}(\omega,n)+(1-\gamma)F_L(\omega,n)*F^*_R(\omega,n)$$

wherein n+1 is an index of an (updated) value being computed and n is an index of a preceding value; ω designates frequency; and γ designates a scalar weighing. Thereby a computationally efficient method of determining at least an estimate of one or more of the power spectra, $P_L$ and $P_R$, and the cross-power spectrum, $P_{LR}$, is/are provided.

Figure 5:
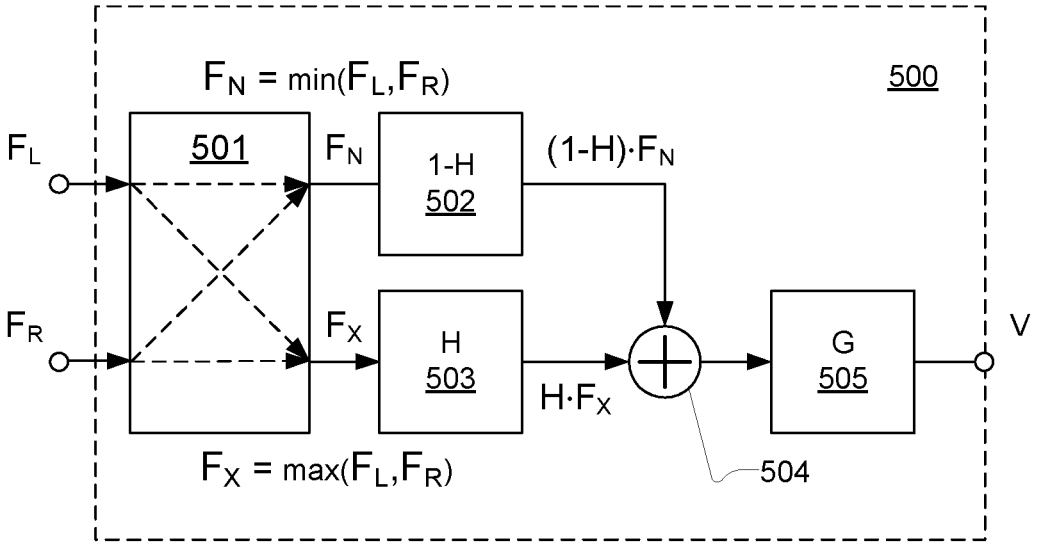
FIG. 5 shows a second equalization unit based on filters.

As an example, FIG. 5 shows an embodiment including the equalization filter and the post-filter which are used in accordance with determining the strongest signal.

From either step 301 or 302 the method proceeds to step 203 wherein a short time inverse Fourier transformation (IFFT) is computed based on V. As a result, a synthesis window, 204, of e.g. 48 time domain samples are generated. The time domain samples may partially overlap previously generated time domain samples. At the overlap, sample values are added. The overlapping and addition is performed in step 205.

As a result, $F_R$H and $F_L(1-H)$ are equalized before summation or, alternatively, $F_L$H and $F_R(1-H)$ are equalized before summation.

Thus, H and 1−H comprises a first gain value H(k) and a second gain value 1−H(k) at least at one or more frequency bins k. In some examples, the first gain value H(k) and a second gain value 1−H(k) are determined in accordance with the above.

FIG. 4 shows a first equalization unit based on gain stages. The first equalization unit is designated by reference numeral 400 and receives the ipsilateral signal, $F_L$, and the contralateral signal, $F_R$. The first gain value a is applied by means of a gain unit 401, which outputs a scaled signal $\alpha F_L$ to an adder 403. Correspondingly, the second gain value $\delta=1-\alpha$ is applied by means of a gain unit 402, which outputs a scaled signal $(1-\alpha)F_R$ to the adder 403. The adder outputs a sum of the signals as the intermediate signal V:

$$V=\alpha F_L+\beta F_R$$

The gain stages are not as such frequency band limited. However, in some embodiments the gain values α and β may each be computed for respective frequency bands or bins, wherein $F_L$ and $F_R$ are frequency band limited signals.

In some examples, the first equalization unit is based on a structure equivalent to the structure shown in FIG. 4. In general, the first equalization unit performs linear combination of the ipsilateral signal, $F_L$, and the contralateral signal, $F_R$. However, some deviations from a linear combination may be accepted or intended.

FIG. 5 shows a second equalization unit based on filters. The second equalization unit, 500, based on filters, may perform the equalization for each of multiple frequency bands, k, by means of an equalization filter H and a post-filter G. In some embodiments, the post-filter G is omitted or temporarily dispensed with.

The second equalization unit designated reference numeral 500, receives the ipsilateral signal, $F_L$, and the contralateral signal, $F_R$.

Since the mutual strength of the ipsilateral signal and the contralateral signal may change from one frequency bin to another, the method selects, for each frequency bin, k, a maximum $F_X(k)$ respectively, a minimum $F_N(k)$ among the ipsilateral signal and the contralateral signal. This is performed by unit 501.

In this embodiment the minimum signal, $F_N$ is input to equalization filter 502. The equalization filter 502 performs filtering in accordance with the transfer function H described above. Output, $(1-H)F_N$, from the equalization filter 502 is input to the adder 504.

The maximum signal, $F_X$, is input to equalization filter 503. The equalization filter 503 performs filtering in accordance with the transfer function H described above. The equalization filter 503 outputs signal $HF_X$. Output, $HF_X$ from the equalization filter 502 is input to the adder 504.

Signals $HF_X$ and $(1-H)F_N$ are thereby equalized per frequency band or frequency bin prior to summation by adder 504.

In some embodiments, additionally, a post-filter 505 implementing the transfer function G filters a signal output from the adder 503 before providing the intermediate signal V. The post-filter 505 performs filtering in accordance with the transfer function G described above.

Figure 6:
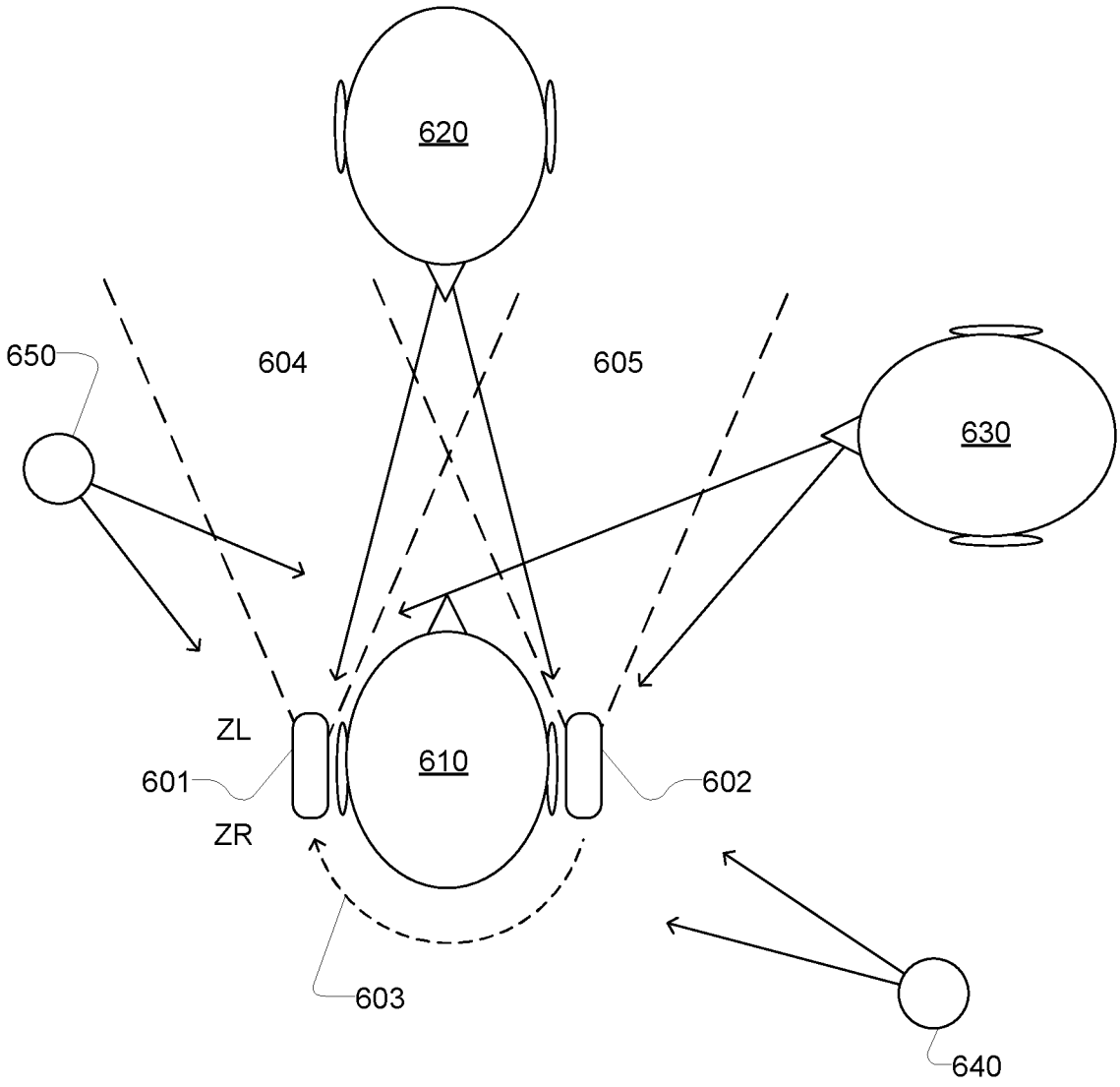
FIG. 6 shows a top-view of a human user and a first target speaker and a second target speaker.

In some examples, the second equalization unit is based on a structure equivalent to the structure shown in FIG. 5. In general, the second equalization unit performs linear combination of the ipsilateral signal, $F_L$, and the contralateral signal, $F_R$, per frequency bin. However, some deviations from a linear combination may be accepted or intended. FIG. 6 shows a top view of a user and a first target speaker and a second target speaker. The user 610 wears an ipsilateral device 601 and a contralateral device 602. The ipsilateral device 601 captures the first directional signal $F_L$ and receives the second directional signal $F_R$ from the contralateral device link 603, e.g. a wireless link.

The first target speaker 620 is on-axis, in front, of the user 610. Therefore, an acoustic speech signal from the first target speaker 620 arrives, at least substantially, at the same time at both the ipsilateral device and the contralateral device whereby the signals are captured simultaneously. In respect of the first target speaker 620, signals $F_L$ and $F_R$ thus have equal strength.

However, a second target speaker 630 is off-axis, slightly to the right, of the user 610. When the second target speaker 630 speaks, the claimed method suppresses the signal from the first target speaker 620, who is on-axis relative to the user, proportionally to the strength of the signal received, at the ipsilateral device and at the contralateral device, from the second target speaker 630, who is off-axis relative to the user. Thereby, it is possible to forgo entering an omnidirectional mode while still being able to perceive the (speech) signal from the second target speaker 630.

In some situations, in the prior art, a determination that a target signal is present e.g. from target speaker 630 may result in a listening device switching to a so-called omnidirectional mode whereby noise sources 650 and 640 all of a sudden contribute to sound presented to the user of a prior art listening device who may be experiencing a significantly increased noise level despite the sound level of the noise sources 650 and 640 being lower than the sound level of the target speaker 630.

At least therefore the claimed method presents advantages over the prior art.

Figure 7:
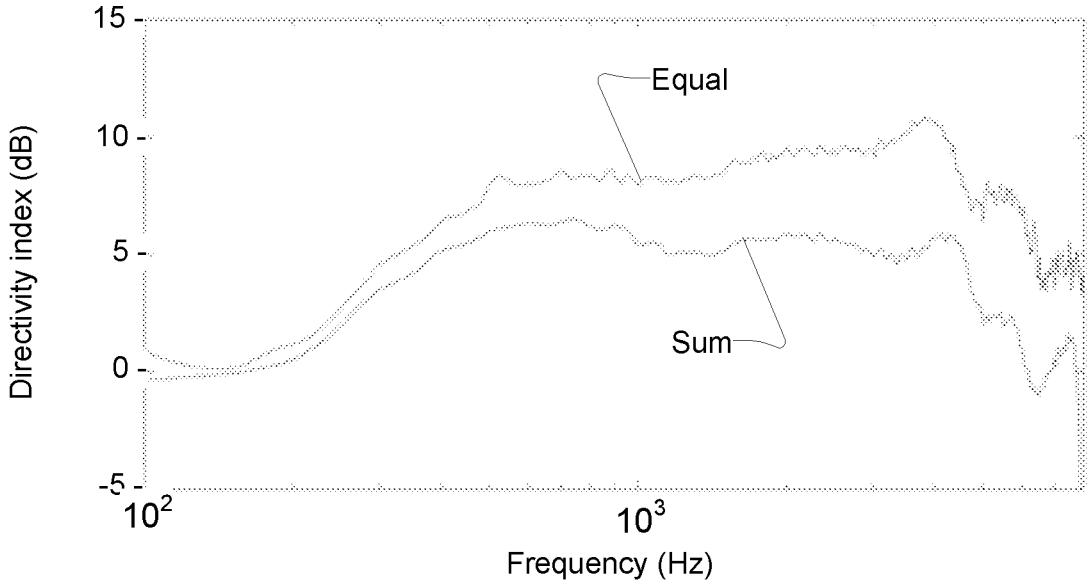
FIG. 7 shows a first example of graphs showing a directionality index.

FIG. 7 shows a first example of graphs showing a directionality index. The graphs are shown in a Cartesian coordinate system with Frequency (Hz) along the abscissa (x-axis) and Directivity index (dB) along the ordinate (y-axis). The graph designated 'Sum' indicates the directivity index for a hearing device without equalization as described herein. The graph designated 'Equal' indicates the directivity index for a hearing device with equalization as described herein, however without a post-filter. There is thus achieved a significant improvement of about 3 dB in terms of improved directionality at least at frequencies above about 500 Hz. However, also at lower frequencies an improvement is achieved.

Figure 8:
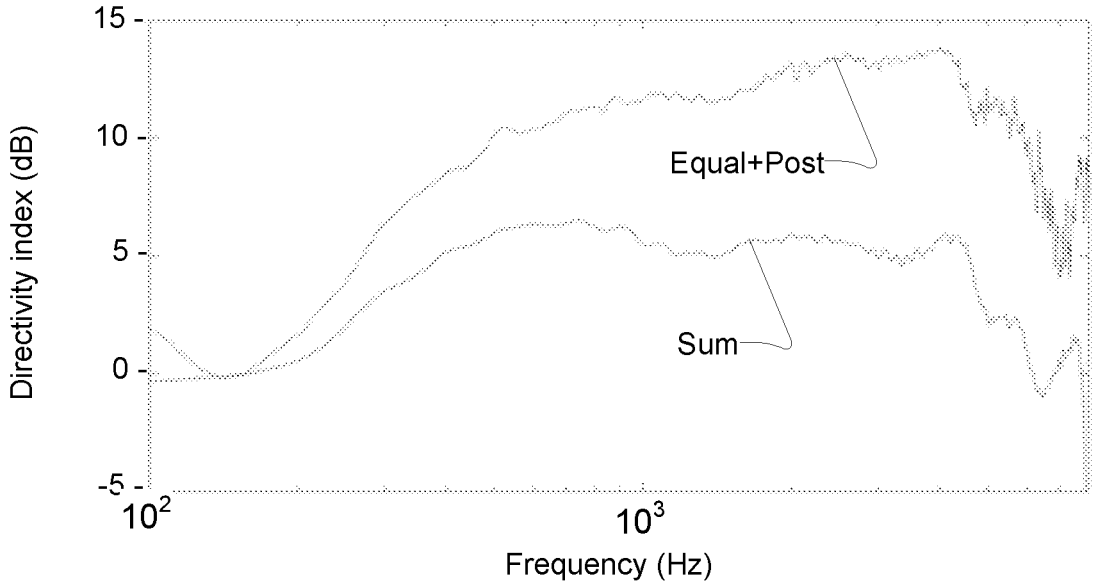
FIG. 8 shows a second example of graphs showing a directionality index.

FIG. 8 shows a second example of graphs showing a directionality index. Here, the graph designated 'Sum' also indicates the directivity index for a hearing device without equalization as described herein. The graph designated 'Equal+Post' indicates the directivity index fora hearing device with equalization followed by post filtering as described herein, thus including a post-filter. There is thus achieved a significant improvement of more than about 5 dB in terms of improved directionality at least at frequencies above about 400 Hz. However, also at lower frequencies an improvement is achieved.

As used in this specification, the term "substantially equal" refers to two values that do not vary by more than 10%.

Although particular embodiments have been shown and described, it will be understood that they are not intended to limit the present inventions, and it will be obvious to those skilled in the art that various changes and modifications may be made without departing from the spirit and scope of the present inventions. The specification and drawings are, accordingly, to be regarded in an illustrative rather than restrictive sense. The present inventions are intended to cover alternatives, modifications, and equivalents, which may be included within the spirit and scope of the present inventions as defined by the claims.

The invention claimed is:

1. A method performed by a first hearing device, the first hearing device comprising a first input unit including one or more microphones and being configured to generate a first directional input signal, a communication unit configured to receive a second directional input signal from a second hearing device, an output unit, and a processor coupled to the first input unit, the communication unit, and the output unit, the method comprising:

determining a first gain value, a second gain value, or both the first and second gain values;

generating an intermediate signal including or based on a combination of the first directional input signal and the second directional input signal, wherein the first and second directional input signals in the combination are combined based on the first gain value, the second gain value, or both of the first and second gain values; and generating an output signal for the output unit based on the intermediate signal;

wherein one or both of the first gain value and the second gain value are determined in accordance with an objective of making a proportion of the first directional input signal and a proportion of the second directional signal at least substantially equal.

2. The method according to claim 1, further comprising recurrently determining the first gain value, the second gain value, or both of the first and second gain values, based on a non-instantaneous level of the first directional input signal and a non-instantaneous level of the second directional input signal.

3. The method according to claim 1, further comprising transforming the first directional input signal and the second directional input signal to a frequency domain by performing respective short-time Fourier transformations;

wherein the intermediate signal and the output signal are generated in the frequency domain; and wherein the method further comprises transforming the output signal from the frequency domain to a time-domain by performing short-time inverse Fourier transformation.

4. The method according to claim 1, wherein the first gain value and/or the second gain value is determined, subject to a constraint that the first gain value and the second gain value sums to a predefined time-invariant value.

5. The method according to claim 4, wherein the first gain value and the second gain value are recurrently determined.

6. The method according to claim 1, wherein the first gain value and/or the second gain value is determined further in accordance with minimizing an auto-correlation or cross power spectrum of the intermediate signal.

7. The method according to claim 1, wherein one or both of the first gain value and the second gain value are recurrently estimated in accordance with adaptively seeking to minimize a cost function, wherein the cost function includes a mean value of a sum of (1) the first gain value multiplied by a numeric value representation of the first directional signal and (2) the second gain value multiplied by a numeric value representation the second directional signal.

8. The method according to claim 7, wherein the cost function includes a constraint that the first gain value and the second gain value sums to a predefined time-invariant value.

9. The method according to claim 1, further comprising iteratively, in a frequency domain:

determining an updated first gain value based on a previous first gain value;

determining an updated second gain value based on a previous second value;

determining an updated value of the intermediate signal including a linear combination of the first directional input signal and the second directional input signal, based on the updated first gain value and the updated second gain value.

10. The method according to claim 9, wherein the updated first gain value is determined also based on an iteration step size multiplied by a difference between the first directional signal and the second directional signal.

11. The method according to claim 9, wherein the updated first gain value is determined also based on a ratio between a value of the intermediate signal and a squared value of the intermediate signal.

12. The method according to claim 1, wherein the first gain value is a frequency dependent gain of a first filter, and/or the second gain value is a frequency dependent gain of a second filter.

13. The method according to claim 1, further comprising transforming the first directional input signal and the second directional input signal to a frequency domain by performing respective short-time Fourier transformations;

wherein the output signal is in the frequency domain; and wherein the method further comprises transforming the output signal from the frequency domain to a time-domain by performing short-time inverse Fourier transformation.

14. The method according to claim 1, wherein the intermediate signal is generated based on one or both of a first filter and a second filter, wherein each or one of the first filter and the second filter is a zero-phase filter.

15. The method according to claim 1, further comprising:

determining a power spectrum of the first directional input signal, and a power spectrum of the second directional input signal;

determining a minimum value and a maximum value among values of the power spectrum of the first directional input signal and the power spectrum of the second directional signal;

determining a first filter value of a first filter in accordance with an algebraic relation between the minimum value and the maximum value; and determining a frequency spectrum of the intermediate signal based on the first filter, a frequency spectrum of the first directional input signal, and a frequency spectrum of the second directional input signal.

16. The method according to claim 15, comprising:

determining a cross-power spectrum of the first directional signal and the second directional signal; and determining a second filter value of a second filter in accordance with a ratio between (1) a value of the cross-power spectrum and (2) a sum of a value of the power spectrum of the first directional input signal and a value of the power spectrum of the second directional input signal;

wherein the frequency spectrum of the intermediate signal is determined further based on the second filter.

17. The method according to claim 1, further comprising filtering a single-channel signal with a single channel post-filter which is configured to suppress an off-axis signal component in the single-channel signal, relative to an on-axis signal component;

wherein the off-axis signal component occurs out-of-phase in the first directional input signal and the second directional signal; and wherein the on-axis signal component occurs in-phase in the first directional input signal and the second directional input signal.

18. The method according to claim 1, further comprising processing the intermediate signal to perform a hearing loss compensation.

19. The method according to claim 18, wherein the intermediate signal is processed to improve a perceived directionality for a wearer of the hearing device.

20. The method according to claim 1, further comprising generating an additional output signal that is substantially equal to the output signal; and communicating the additional output signal to the second hearing device;

wherein the output signal and the additional output signal constitute a monaural signal.

21. The method according to claim 1, wherein the combination comprises a linear combination.

22. The method according to claim 1, wherein the combination is determined at least by a sum of (1) the first directional input signal scaled in accordance with the first gain value, and (2) the second directional input signal scaled in accordance with the second gain value.

23. A hearing device, comprising:

a first input unit including one or more microphones;

a communication unit;

an output unit comprising an output transducer;

at least one processor coupled to the first input unit, the communication unit, and the output unit; and a memory storing at least one program, wherein the at least one program is executable by the hearing device to cause the hearing device to perform the method of claim 1.

24. A non-transitory computer readable storage medium storing a set of instructions, an execution of which by at least one processor of a hearing device will cause the hearing device to perform the method of claim 1.

25. A method performed by a first hearing device, the first hearing device comprising a first input unit including one or more microphones and being configured to generate a first directional input signal, a communication unit configured to receive a second directional input signal from a second hearing device, an output unit, and a processor coupled to the first input unit, the communication unit, and the output unit, the method comprising:

generating an intermediate signal including or based on a combination of the first directional input signal and the second directional input signal, wherein the first and second directional input signals are combined in the combination based on one or both of a first filter transfer function and a second filter transfer function;

generating a first power spectrum based on the first directional input signal and the second directional input signal;

generating a cross power spectrum based on the first directional input signal and the second directional input signal;

for one or more frequency bands, determining a first value and a second value among an estimated power value of the first directional input signal and an estimated power value of the second directional input signal;

generating a first filtered signal by filtering the first directional input signal by an equalization filter, or by filtering the second directional input signal by the equalization filter, wherein the equalization filter is based on an algebraic relation between the first value and the second value; and generating an output signal based on the first filtered signal.

26. The method according to claim 25, wherein the act of generating the output signal comprises combining (1) the first filtered signal with (2) a signal based on the second directional input signal or the first directional input signal.

27. The method according to claim 25, wherein the first value comprises a minimum value.

28. The method according to claim 25, wherein the second value comprises a maximum value.

29. The method according to claim 25, wherein the algebraic relation comprises a ratio or a root of the ratio.

* * * * *